United States Patent [19]

Ashworth et al.

[11] 4,395,975

[45] Aug. 2, 1983

[54] METHOD FOR DESULFURIZATION AND OXIDATION OF CARBONACEOUS FUELS

[76] Inventors: Robert A. Ashworth, 1017 41st Ave., NE., St. Petersburg, Fla. 33703; Antonio A. Padilla, 15803 Deep Creek La., Tampa, Fla. 33624; Larry A. Rodriguez, 7452 18th St., NE., St. Petersburg, Fla. 33702; Ned B. Spake, 2711 Summerfield Dr., Winter Park, Fla. 32792

[21] Appl. No.: 341,768

[22] Filed: Jan. 22, 1982

[51] Int. Cl.[3] ..... C10J 1/00

[52] U.S. Cl. ..... 122/5; 44/15 R; 48/77; 48/210; 110/229; 201/17

[58] Field of Search ..... 110/229, 347; 48/77, 48/202, 206, 210; 201/17; 44/15 R; 122/5

[56] References Cited

U.S. PATENT DOCUMENTS 3,818,869 6/1974 Blaskowski ..... 110/229 X 4,017,271 4/1977 Barclay ..... 49/210 X 4,285,283 8/1981 Lyoh et al. ..... 110/229 X

*Primary Examiner*—Edward G. Favors

*Attorney, Agent, or Firm*—Duckworth, Allen, Dyer & Pettis

[57] ABSTRACT

A method for desulfurization and oxidation of carbonaceous fuels including a two stage oxidation technique. The carbonaceous fuel, along with an oxygen-containing gas is introduced into a first stage partial oxidation unit containing molten slag maintained at a temperature of about 2200°-2600° F. A flux may also be introduced into the first stage partial oxidation unit for the purpose of maintaining the viscosity of the molten slag at a value no greater than about 10 poise. The carbonaceous fuel is gasified, and sulfur is chemically bound and captured in the molten slag. The combustible gas derived from partial oxidation and gasification is directed along a substantially horizontal path to a second stage oxidation unit for final combustion. The sulfur-containing slag is removed to a water-sealed quench system for disposal.

14 Claims, 1 Drawing Figure

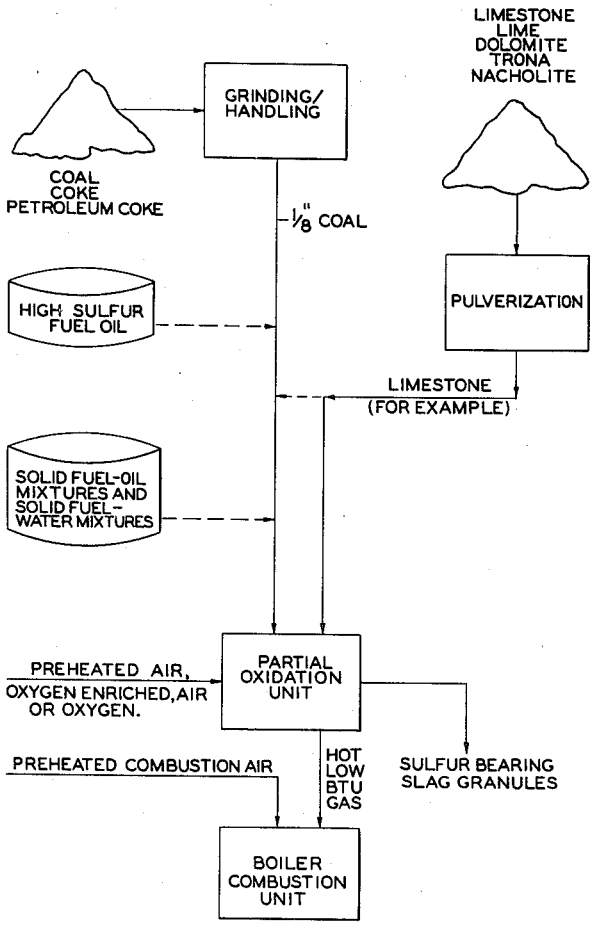

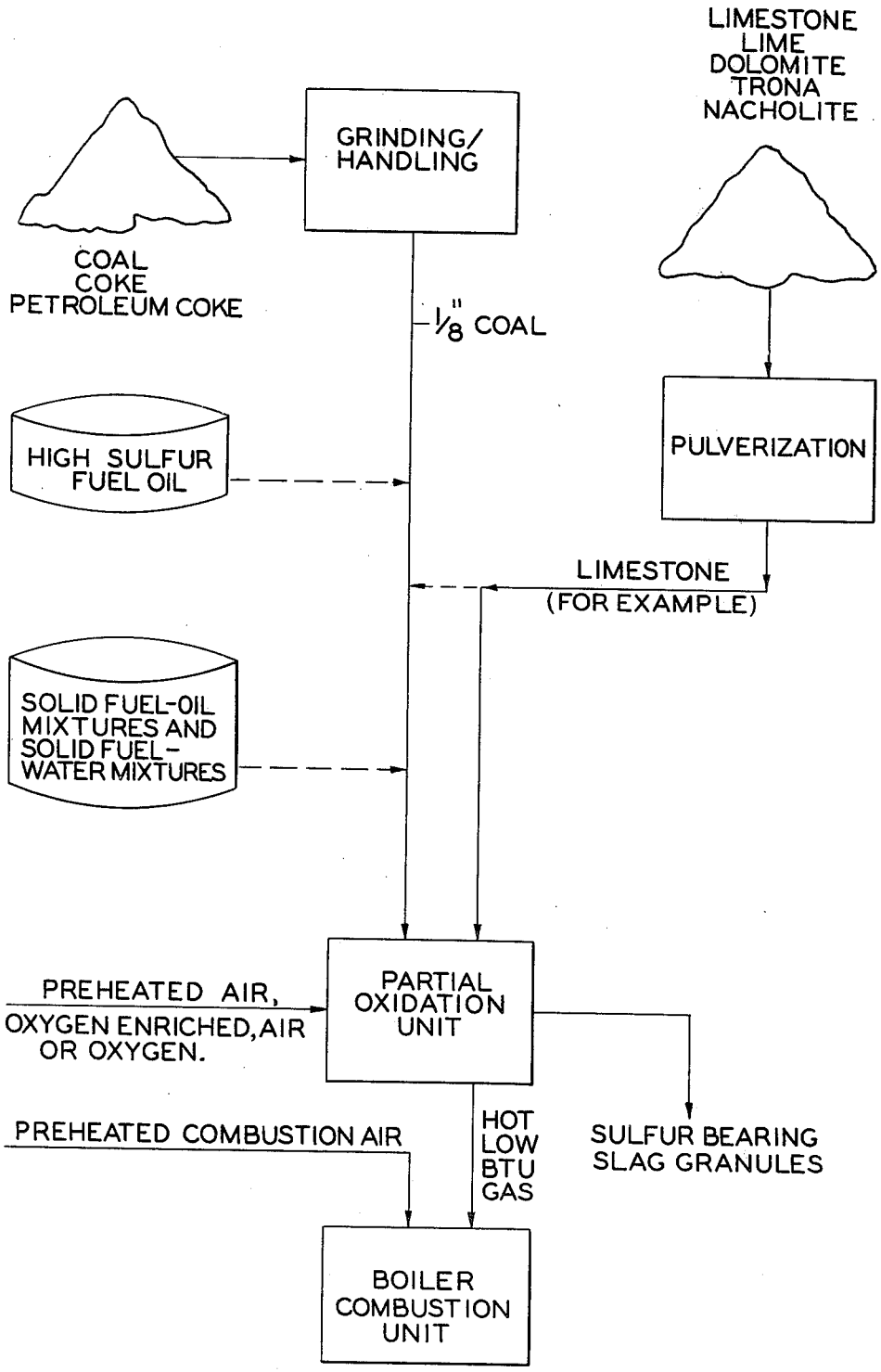
LIMESTONE
LIME
DOLOMITE
TRONA
NACHOLITE
GRINDING/
HANDLING
COAL
COKE
PETROLEUM COKE
1/8" COAL
HIGH SULFUR
FUEL OIL
PULVERIZATION
LIMESTONE
(FOR EXAMPLE)
SOLID FUEL-OIL
MIXTURES AND
SOLID FUEL-
WATER MIXTURES
PREHEATED AIR,
OXYGEN ENRICHED, AIR
OR OXYGEN.
PARTIAL
OXIDATION
UNIT
PREHEATED COMBUSTION AIR
HOT
LOW
BTU
GAS
SULFUR BEARING
SLAG GRANULES
BOILER
COMBUSTION
UNIT

METHOD FOR DESULFURIZATION AND OXIDATION OF CARBONACEOUS FUELS

BACKGROUND OF THE INVENTION

1. Field of the Invention

The present invention relates to a two stage method for the desulfurization and oxidation of carbonaceous fuels and is particulary suitable for use in boiler retrofit applications whereby the combustible gas obtained in a first stage partial oxidation unit may be utilized as a primary fuel in the second stage oxidation unit, which preferably comprises a boiler combustion unit. Sulfur contained in the original carbonaceous fuel is removed for disposal as sulfur bearing slag granules.

2. Description of the Prior Art

The use of carbonaceous fuels, both solid and liquid, is of course well known in the prior art as an energy source. However, in recent years users of carbonaceous fuels throughout the world have become more and more concerned with the adverse effects on our environment, and particularly air quality as a result of burning carbonaceous fuels having a high sulfur content. Of particular concern in the prior art have been various methods and devices for "capturing" and removing sulfur dioxide gas generated upon combustion of such fuels. This problem has become relatively more extreme in recent years because of both the rising costs and relative scarcity of low sulfur solid and liquid carbonaceous fuels.

With particular regard to high sulfur carbonaceous fuels such as coal, the prior art literature is replete with numerous means for gasifying the coal to obtain a hot gaseous fuel while at the same time removing the sulfur therefrom. U.S. Pat. No. 4,062,657 to Knuppel discloses a method and apparatus for desulfurizing in the gasification of coal. This patent teaches the use of molten iron as a heat transfer media and chemical reactant for removal of sulfur during gasification of the coal. The patent further teaches that coal, lime and oxygen are introduced into the molten iron bath through bottom mounted tuyeres. The overall effect of this process is that the sulfur, as calcium sulfide, ends up in a slag layer which floats on the molten iron that flows to a separate chamber where the slag is desulfurized through reaction with oxygen to obtain calcium oxide and sulfur dioxide.

U.S. Pat. No. 2,830,883 to Eastman also discloses a process for gasification of solid carbonaceous fuels including sulfur. This process calls for the introduction of coal, lime, water and oxygen vertically downward into a reactor vessel. The product gas exits through the side of the vessel and is immediately quenched with water. The slag drops into a water bath in the bottom of the vessel where it is transferred to a clarifier for settling. In accord with the disclosure of that patent the reactor is designed for operating temperatures above 2,000° F. and operating pressures of 100 psig or greater.

Other prior patents also teach the use of alkalis to remove sulfur as either hydrogen sulfide or sulfur dioxide in situ in a gasifier or fluid bed combustor, or from hot gas exiting a gasifier. These patents are as follows:

| Inventor | U.S. Pat. No. |
|---|---|
| Squires | 3,481,834 |
| Sass | 3,736,233 |
| Gasior | 3,970,434 |

-continued

| Inventor | U.S. Pat. No. |
|---|---|
| Van Slyke | 3,977,844 |
| Collin | 4,026,679 |
| Harris | 4,092,128 |
| Wormser | 4,135,885 |
| Kimura | 4,155,990. |

Accordingly, it is clear that it is known to remove sulfur in a gasification process based upon the reactivity of a basic slag to react with hydrogen sulfide. The U.S. Bureau of Mines reported this phenomenon during their experimental pulverized coal gasification pilot plant work in the early 1950's. Slag bath reactors such as the Rummel gasifier developed in Germany and incorporating feed nozzles that are above molten slag have been used for such gasification. However, the gasifiers required large water wall boiler sections to provide for adequate carbon conversion and slag quenching before the hot gases exited the gasifier proper. This was necessary for these gasifiers were not close coupled to a boiler. Of course, other alternatives for the removal of sulfur compounds from carbonaceous fuels and the exhaust of their combustion are also known in the prior art.

Chemical desulfurization of coal may be accomplished, and this results in coal of very fine particle size and an associated degree of carbon loss. If desulfurization is accomplished at a mine mouth, transportation by any means other than coal slurry is extremely difficult due to the resultant fine coal particle sizes. If desulfurization is accomplished at the point of use, solids disposal can present a problem. Technology clearly exists for chemical desulfurization of coal, but the method is fairly expensive and is not known to be in use in a commercial plant today.

Coal liquefaction is another alternative, but is expensive and considering economics, must be accomplished near the mine mouth. The necessary technology is quite sophisticated, and the resulting product is relatively expensive.

Conventional coal gasification followed by conventional hydrogen sulfide removal, from an economic viewpoint, simply does not appear to be a viable application for producing a boiler fuel. Only if the gas from the gasifier were already low in hydrogen sulfide and the gas could be kept above its dew point, would such conventional gasification appear to be a working alternative. Obviously, though, the use of carbon, high in sulfur content, would not be indicated; the necessary hydrogen sulfide removal feature is not present.

Finally, coal combustion followed by sulfur dioxide removal is commercially proved and operable, although the reliability of such a system is still sometimes questionable. A penalty on efficiency is paid due to flue gas pressure drop through the sulfur dioxide scrubber. Booster fans and reheating of flue gas after scrubbing results in overall efficiency losses of 1–2%, or loss of available power to sell of 3–6%. Accordingly, such systems are relatively costly, and in many cases a sludge is produced which is quite difficult to dispose of.

It is therefore apparent that there is a great need in the art for an economical, yet effective, method for desulfurizing and oxidizing carbonaceous fuels. Such a method would permit the utilization of high sulfur fuels at low capital expense and operating costs. It would furthermore be desirable if such a method would be suitable for producing a gaseous fuel which might be directly fed to existing coal and oil fired boilers as well as for use in new installations. Preferably, 55–90 wt. % of the sulfur content of the carbonaceous fuel should be removed, any auxillary power requirements associated with desulfurization and oxidation should be minimized, and the sulfur-containing waste material should be innocuous with regard to environmental concerns associated with solids disposal.

SUMMARY OF THE INVENTION

The scope of the present invention comprises a method for desulfurization and oxidation of carbonaceous fuels. A primary purpose of the invention is to replace or supplement costly low sulfur coal and fuel oil, and in come cases natural gas, with less costly high sulfur fuels, and to do so in an environmentally acceptable manner. The process is particularly suitable for use in a retrofit mode whereby existing boilers may be modified to accept the method and its resulting combustible gas, but the process may also be utilized in new installations.

The method basically comprises a two stage oxidation technique which takes advantage of the sulfur retention capability of a basic molten slag that is being maintained under reducing conditions. In the first stage, a fuel such as high sulfur coal is partially oxidized in a slag bath reactor. A flux material comprising limestone, lime, dolomite, or other alkali minerals such as trona and nacholite is introduced along with the coal to improve the basicity of the ash, and to provide a viscosity of the molten slag at a value of no more than about 10 poise at its operating temperature of about 2,000°–2,600° F. Of course, an oxygen-containing gas such as, for example, air is also introduced into this first stage.

The coal, limestone and air are injected tangentially at an angle of about 40°–50° downward with respect to the surface of the molten slag at sufficient velocity to impart a swirling motion to the slag and the gases produced within this first stage. This tangentially downward injection also facilitates slag droplets being thrown to the wall and retained in the reactor rather than being carried along with hot gases out the gas exit pipe. Thus, due to the rapid reactant injection into the molten slag, the reactants are brought into intimate contact with the slag and with each other. The slag bath acts not only as a reactant to remove hydrogen sulfide from the gases produced, but also acts as a heat storage and transfer medium for gasification. The slag assists in gasification in that large particles of coal float on the surface until they are gasified. Accordingly, it is possible to feed coal with an average particle size of 20–24 mesh, and a maximum size of up to ⅛ inch. However, the flux (limestone) should be pulverized to 70% less than 200 mesh in order to prevent the limestone from merely floating on the molten slag surface.

The gaseous products from the partial oxidation in this first stage are primarily carbon monoxide, hydrogen, carbon dioxide, water and nitrogen. The hot gases exit this first stage and are completely oxidized, or combusted, in a close coupled boiler which comprises the second stage oxidation unit. The sulfur bearing slag exits the first stage to a water sealed quench system where the slag is quenched, dewatered and conveyed away for solids disposal.

A significant feature of the method of this invention comprises transferring the combustible gas generated in the first stage partial oxidation unit along a substantially horizontal path to the second stage oxidation unit for combustion. The horizontal path of the gas is baffled as it exits the first unit causing it to be directed in a relatively downward direction into the horizontal path. As the sulfur containing slag is withdrawn from the first oxidation unit, it is directed along a substantially horizontal pathway common to that of the gas prior to delivery of the slag to the quench system. Accordingly, the slag droplets entrained by the gas will tend to impinge on the slag and be retained therein. The hot slag thereafter drops in the water, resulting in rapid quenching and solidification thereof. It is believed that the sulfur is bound in a complicated eutectic form, and the refractory nature of the quenched slag will prevent hydrolysis of the alkali sulfides to oxides and hydrogen sulfide. The combustible gases from the first stage unit pass on to the second stage oxidation unit which, as indicated above, may comprise a boiler. These gases, mixed with a proper amount of combustion air, may be utilized as a primary fuel for the boiler. Any molten slag that is carried over into the boiler is removed as bottom ash and fly ash according to conventional methods and procedures.

As is set forth in greater detail hereinafter, by virtue of the method of this invention at least about 50–99%, by weight, of the sulfur content of the carbonaceous fuel is removed. It has furthermore been determined that at least about 50–80%, by weight, of the sulfur containing slag generated in the gasification process within the first unit will exit via the slag outlet, and that no more than about 20–50%, by weight, will be carried into the boiler. Orientation of the outlet gas pipe along a horizontal path, rather than vertical as is normal in most prior art systems, significantly precludes slag buildup in the gas outlet. Furthermore, carbon conversion to combustible gas is estimated to be at least about 98%.

The invention accordingly comprises the several steps in the relation of one or more of such steps with respect to each of the others thereof, which will be exemplified in the method hereinafter disclosed, and the scope of the invention will be indicated in the claims.

BRIEF DESCRIPTION OF THE DRAWING

For a fuller understanding of the nature and objects of the invention, reference should be had to the following detailed description taken in connection with the accompanying drawing which sets forth the method of this invention in a simplified block flow diagram.

DETAILED DESCRIPTION

The scope of the present invention comprises an improved method for desulfurization and oxidation of carbonaceous fuels wherein the method is especially suitable for boiler retrofit applications. The concept of the invention is based on the fact that fuel sulfur can be captured in basic molten ash slag according to the following example equation:

$$CaCO_3 + H_2S = CaS + CO_2 + H_2O; \text{ and} \quad (1)$$

$$CaO + H_2S = CaS + H_2O. \quad (2)$$

Accordingly, an important feature of the method of this invention resides in the fact that whereas hydrogen sulfide is captured in a molten slag being maintained under reducing conditions, sulfur dioxide is, in comparison, only very slightly retained in slag produced under oxidizing conditions such as are present in pulverized coal fired boilers.

The method of the present invention utilizes a two stage oxidation technique in order to take advantage of the sulfur retention capability of a basic molten slag being maintained under reducing conditions. In the first stage partial oxidation unit high sulfur coal is partially oxidized in a slag bath reactor. A flux, comprising for example limestone, may be introduced with the coal in order to improve the basicity of the ash. The coal, limestone and air are injected at high velocities and impart a swirling motion ot the molten slag bath which is being maintained at about 2,200°–2,600° F. The high velocity injection provides for a good contact between the coal, gases produced and the slag. The hot gaseous products from the partial oxidation process exit the first unit and are completely oxidized in the second stage oxidation unit, which may comprise a close coupled boiler. The sulfur containing slag exits the first partial oxidation unit to a water sealed quench system where the slag is quenched, dewatered and conveyed away for disposal.

It is to be remembered that the two stage method described above can be retrofitted to coal, oil, and in some cases, natural gas fired boilers. By virtue of the method of this invention, high sulfur solid and/or liquid fuels can be utilized, replacing expensive low sulfur coal, fuel oil, or natural gas as boiler fuel. Basic molten slag sulfur removal efficiencies as high as 94–99%, by weight, have been demonstrated for the molten alkali carbonates utilized in the process. The reaction of molten alkali oxides with hydrogen sulfide has also been demonstrated.

As shown in the schematic diagram, the sulfur containing fuel can be injected with limestone, lime, dolomite, or other alkali minerals, or can be injected separately. Although the solid carbonaceous fuel (coal) can be ground to a size of just ⅛ inch, the flux (for example, limestone) should be pulverized to 70% less than 200 mesh in order to prevent the flux from merely floating on the molten slag surface.

The slag bath reactor utilizes as the first stage partial oxidation unit is patterned after the Rummel gasifier developed in Germany, which incorporates feed nozzles that are above the swirling molten slag. The feed nozzles that are above the swirling molten slag. The feed nozzles utilized in the method of the present invention are angled downwardly for a tangential injection of the fuel with the oxidizing gaseous medium, air, oxygen enriched air, or oxygen and limestone, dolomite, or other alkali minerals such as trona or nacholite into the swirling molten slag bath reactor. The air-to-coal ratio is set to yield a temperature that will maintain a suitable vicosity of the molten slag in order to insure good coal-air-slag mixing. The addition of for example, limestone to the coal, will in most cases reduce the viscosity of the molten slag so that the reactor slag temperature can be maintained at a lower temperature than would be the case if no limestone were added. According to the method of the present invention, the reactor slag temperature should be maintained within a range of 2,200°–2,600° F., and the slag viscosity should preferably be no greater than about 10 poise.

While the chemistry involved in the reaction of basic slag components with sulfur components, such as hydrogen sulfide, is quite complicated, it is certainly known that ash component oxides and carbonates, such as iron, calcium, magnesium, potassium and sodium, will react with hydrogen sulfide to form sulfides, carbon dioxide and/or water. In the mode of operation where carbon dioxide is produced during partial coal combustion and that carbon dioxide comes into intimate contact with the slag, it is believed that alkali carbonates will exist in the slag. Even if the alkali carbonates decomposed to the oxide form, the oxides will also react with hydrogen sulfide.

Assuming coal to be the carbonaceous fuel utilized, and as shown in the simplified block flow diagram of the drawing, the preferred method of the present invention consists of four major units:

1. Coal grinding/handling.
2. Limestone pulverization
3. Partial oxidation (First Stage)
4. Combustion (Second Stage)

Run of mine Indiana #6 coal was fed the grinding/handling unit where it was ground to an average particle size of 20–24 mesh with a maximum size of ⅛ inch. Drying of the coal was not required. The ground coal was then pneumatically conveyed to the partial oxidation unit.

Meanwhile, for example, limestone was pulverized to 70% minus 200 mesh and also pneumatically conveyed to the partial oxidation unit, or alternatively mixed with the coal and then pneumatically conveyed with the coal into the partial oxidation unit. The ratio of limestone-to-coal will vary depending upon the sulfur content of the coal, the degree of sulfur removal desired, and the coal ash composition.

Coal, and for example limestone and preheated air are then injected tangentially (40–50 degrees downward) into the partial oxidation unit where the coal is gasified. The tangential injection imparts a swirling motion to the produced gases which facilitates slag droplets being thrown to the wall and retained in the reactor rather than being carried along with the hot gases out the gas exit pipe. With operation of the partial oxidation unit, solid slag will build up to an equilibrium thickness on the walls that will protect the refractory and provide a slag wear surface. In this way, slag will be eroding slag rather than refractory.

An internal slag retaining wall is provided for prohibiting ungasified coal particles from exiting the molten slag and provides for increased carbon conversion. The slag retaining wall also acts as a gas baffle. The hot combustible gases leaving the partial oxidation unit in a swirl are directed upwardly, over the slag retaining wall, and then downwardly and into the horizontal outlet gas pipe. Overflow molten slag also enters the horizontal outlet gas pipe and travels along the bottom thereof to the slag outlet quench pipe. Since the hot combustible gases are directed vertically downward as they enter the horizontal outlet gas pipe, slag droplets again will have a tendency to impinge on the slag and be retained therein rather than being carried as droplets into the second stage oxidation unit (boiler combustion unit). Accordingly, a secondary feature of the hot outlet gas is to maintain the slag hot and insure its fluidity all the way to the slag outlet quench pipe.

The outlet gas pipe is, by specific design, horizontal to vertically downward rather than vertically upward in order to preclude slag buildup therealong. Prior art work on slag bath reactors with upward vertical pipe gas outlets has shown systems wherein slag continually has plugged the outlet line. With such an upward vertical construction the slag would cool rather than drop back into the reactor due to its inability to overcome the high outlet gas velocity. With a horizontal to vertically downward outlet, as is called for in the method of this invention, any molten slag droplets that are carried over from the reactor will either fall into the liquid slag overflow or be entrained into the boiler for removal as bottom ash and fly ash.

Also as shown in the simplified block flow diagram of the drawing, the second stage oxidation unit called for in practicing the method of this invention comprises a boiler combustion unit consisting of a burner pipe and a preheated combustion air injection system. The hot, low Btu combustible gas from the partial oxidation unit is fired into the boiler with the prescribed amount of excess air, as is the practice for any fossil fuel fired boiler. In addition to the method of the present invention being utilized with coal as the carbonaceous fuel, it is envisioned that through minor mechanical modifications, coke, petroleum coke, high sulfur fuel oil, solid fuel-oil mixtures, and solid fuel-water mixtures, could be used as well, as indicated in the simplified diagram. It should also be noted that in the event a small amount of hydrogen sulfide is liberated during quenching of the molten slag, a small air blower may be used to draw air continually over the quench tank water surface and direct the air flow to the preheat combustion air for the boiler. Should such operating conditions be detected, additional, for example, limestone would simply be added into the partial oxidation unit to insure adequate sulfur removal.

It will thus be seen that the objects set forth above, among those made apparent from the preceding description, are efficiently attained, and since certain changes may be made in carrying out the above method without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for desulfurization and oxidation of carbonaceous fuels, said method comprising the steps of:

a. introducing said carbonaceous fuel into a first stage partial oxidation unit containing molten slag at a temperature of about 2,200° F.–2,600° F.;

b. simultaneously introducing a flux into said first unit in sufficient quantity to maintain the viscosity of said molten slag at no more than about 10 poise;

c. simultaneously introducing oxygen-containing gas into said first unit, whereby partial oxidation of said carbonaceous fuel occurs to generate a combustible gas and at least about 50–99%, by weight, of the sulfur content of the carbonaceous fuel is chemically captured in said slag;

d. transferring said combustible gas along a substantially horizontal path to a second stage oxidation unit for combustion;

e. removing said sulfur containing slag to a water-sealed quench system for disposal.

2. A method as in claim 1 further comprising selecting said carbonaceous fuel from the class consisting essentially of coal, coke, petroleum coke, fuel oil, mixtures thereof and aqueous mixtures thereof.

3. A method as in claim 2 further comprising grinding said coal to a particle size no greater than about 0.125 inch prior to said introducing step a.

4. A method as in claim 1 wherein said fuel, said flux and said gas are tangentially injected into said first unit above the surface of said molten slag.

5. A method as in claim 4 wherein said tangential injection comprises pneumatically feeding said fuel, flux and gas, and mixtures thereof, through nozzles mounted downwardly toward said surface of said molten slag at an angle of about 40°–50° with respect to said surface.

6. A method as in claim 1 further comprising selecting said flux from the class consisting essentially of alkali minerals.

7. A method as in claim 6 further comprising selecting said flux from the class consisting essentially of lime, limestone, dolomite, trona, nacholite, and mixtures thereof.

8. A method as in claim 6 further comprising pulverizing said flux to a particle size of about 70% less than 200 mesh prior to said introducing step b.

9. A method as in claim 1 further comprising transferring said gas and removing said sulfur containing slag along a partially common pathway prior to delivery of said sulfur containing slag to said quench system, whereby any slag droplets entrained by said gas will tend to impinge on said sulfur containing slag and be retained therein.

10. A method as in claim 9 further comprising baffling said substantially horizontal path of said gas, whereby said gas will be directed downwardly toward said sulfur containing slag as gas enters said common pathway.

11. A method as in claim 1 wherein said oxygen-containing gas is air.

12. A method as in claim 1 wherein said oxygen-containing gas is oxygen enriched air.

13. A method as in claim 1 wherein said oxygen-containing gas is oxygen.

14. A method as in claim 1 wherein said second stage oxidation unit comprises a boiler combustion unit, said combustible gas being the fuel thereof.

* * * * *